United States Patent [19]

Nedelcu

[11] Patent Number: 4,866,803

[45] Date of Patent: Sep. 19, 1989

[54] BRIDGE STRUCTURE WITH INCLINED TOWERS

[76] Inventor: Lucian I. Nedelcu, 10 Textbook Ave., Rocky Hill, Conn. 06067

[21] Appl. No.: 261,345

[22] Filed: Oct. 24, 1988

[51] Int. Cl.[4] ..... E01D 11/00

[52] U.S. Cl. ..... 14/19; 14/21

[58] Field of Search ..... 14/1, 18–21

[56] References Cited

U.S. PATENT DOCUMENTS

| | | | |
|---|---|---|---|
| 285,257 | 9/1883 | Griffith | 14/21 X |
| 513,389 | 1/1894 | Greer | 14/20 |
| 629,902 | 8/1899 | Gunn | 14/21 |
| 630,809 | 8/1899 | Gunn | 14/21 |
| 3,114,161 | 12/1963 | Colombot | 14/18 |
| 4,535,498 | 8/1985 | Webster | 14/18 |
| 4,799,279 | 1/1989 | Muller | 14/1 |

FOREIGN PATENT DOCUMENTS

| | | | |
|---|---|---|---|
| 1154138 | 9/1963 | Fed. Rep. of Germany | 14/21 |
| 1214816 | 2/1986 | U.S.S.R. | 14/18 |

*Primary Examiner*—Jerome W. Massie, IV
*Assistant Examiner*—Matthew Smith

[57] ABSTRACT

A bridge structure for large water crossing with inclined towers as main substructure members. The superstructure is a combination of suspension cables and stay cables supported by inclined towers which transfers the bridge loads to the ground. The inclined towers are tied with horizontally cables posttensioned in a such way to introduce a horizontal force which combined with the vertical forces from the bridge gives axial forces for the inclined towers, improving its load capacity.

4 Claims, 4 Drawing Sheets

BRIDGE STRUCTURE WITH INCLINED TOWERS

BACKGROUND OF THE INVENTION

The present invention is generally related to a bridge structure with long spans over large water crossing. Known methods for constructing bridge structures over large water crossing have as their objective to reduce the number of the structure supports increasing the length of the span between two adjacent supports. There are two main methods for spanning large water ways.

According to the first alternate method the bridge structure is supported by vertical cables, known as hangers or suspenders cables which in turn are suspended from longitudinal cables known as suspension cables bearing on vertical towers and anchored at their ends. The loads due to the superstructure and design traffic are transferred by the suspension cables to the vertical towers and to the end anchorages. The bridge structure is known as a suspension bridge structure where the main span is the distance between the towers and the side span is the distance between the tower and the anchorage system and there are two side spans.

According to the second alternate method, the bridge structure is supported by inclined cables which in turn are anchored to or supported by the vertical towers, the system being known as a stay cable bridge structure. The loads due to the superstructure and design traffic loads are transferred by the inclined cables to the vertical towers.

The disadvantage of the first method is that the length of the main span is limited to the strength of the suspension cables. When the length of the main span increases the load in the suspension cables and the height of the vertical towers increases. Another disadvantage is that during erection the bridge structure requires additional measures for its stability.

The disadvantage of the second method is that the horizontal component of the force in the inclined cables becomes too big for large structures and can not be taken by the bridge superstructure. Also, the required height of the tower increases with the span length.

SUMMARY OF THE INVENTION

The present invention represents a bridge structure with large span to be used for water crossings. To achieve this purpose, the bridge structure is provided with abutments, suspension cables, inclined cables, and inclined towers tied with horizontal cables.

It is an objective of this invention to develop a bridge structure with large opening for water crossing.

Another objective of this invention is to use inclined towers, reducing the length of the main span for the same water opening.

Another objective of this invention is to reduce the height of the towers.

Another objective of this invention is to transfer the vertical loads due to the bridge structure to the inclined towers in a form of axial loads minimizing the bending moment in the inclined towers.

Another objective of this invention is to increase the stability of the bridge structure during erection of the bridge. Another objective of this invention is to improve the response of the bridge structure to the dynamic loads acting on the bridge. Another objective of this invention is to reduce the weight of the bridge structure hence its cost.

BRIEF DESCRIPTION OF THE DRAWINGS

Other objectives and advantages of this invention will become more apparent from the specifications taken in conjunction with the accompanying drawings in which.

DETAILED DESCRIPTION OF THE INVENTION

Figure 1:
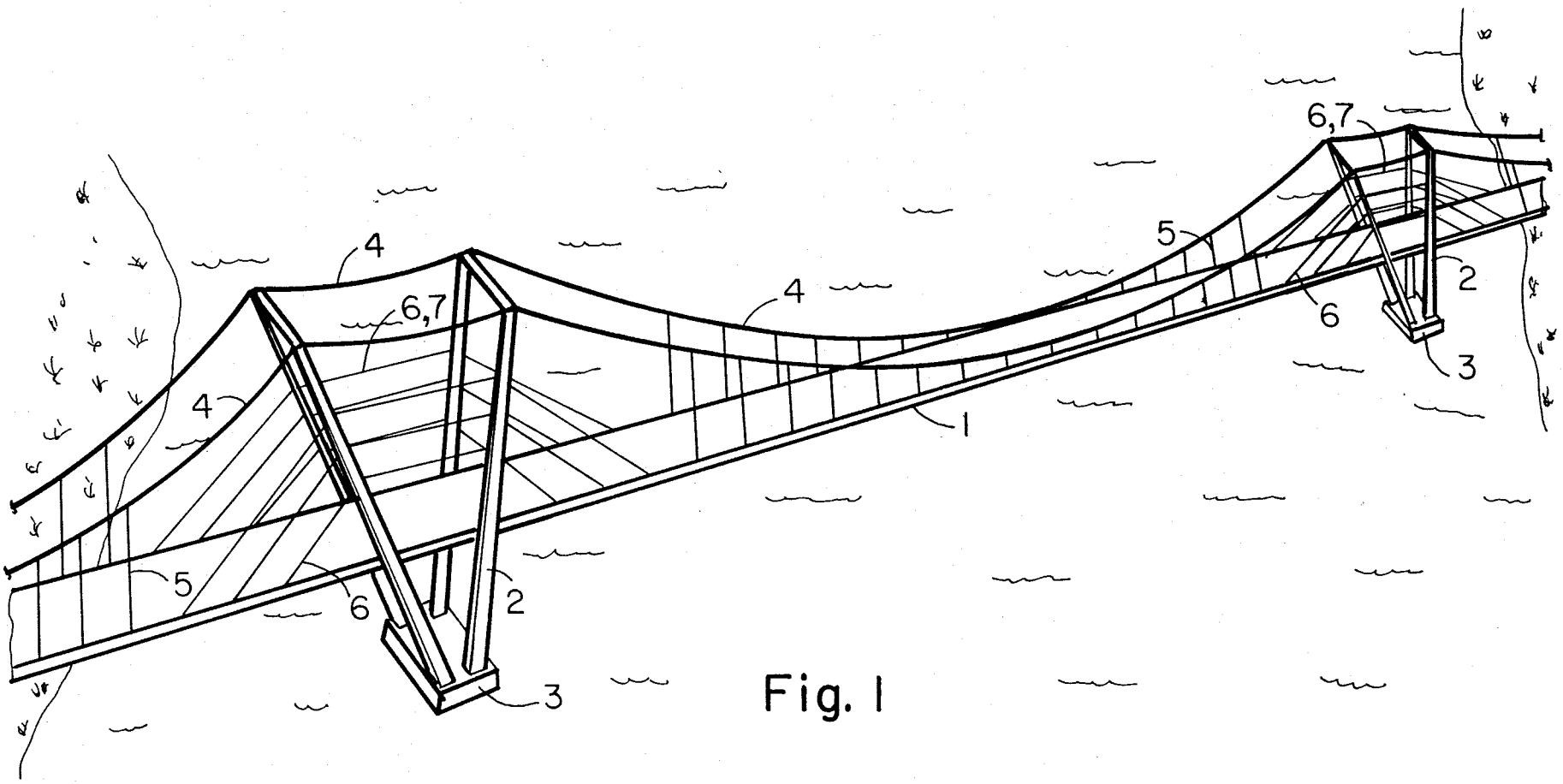
FIG. 1 represents a perspective view of the bridge with inclined towers

Referring to the drawing shown in FIG. 1:

Numeral 1 designates a bridge superstructure which can be made of steel, concrete or a combination of these two materials, numeral 2 designates inclined towers which can be made of concrete, steel or a combination of these two materials, Numeral 3 designates the foundation of the inclined towers made of concrete, Numeral 4 designates a suspension cable made of steel with a high strength, Numeral 5 designates vertical hangers made of steel and suspended to the suspension cables, numeral 4, at one one end and anchored to the bridge superstructure, numeral 1, at the other end, Numeral 6 designates inclined cables made of steel with a high strength either and anchored to the inclined towers, numeral 2, at one end and to the bridge structure, numeral 1, at the other end or anchored to the bridge superstructure, numeral 1, at both ends and supported by the inclined towers, numeral 2, at its median portion, Numeral 7 designates horizontal cables made of steel with a high strength, anchored and stretched against the inclined towers, numeral 2, Numeral 8 designates abutments of the bridge structure provided with an anchorage system for the suspension cable, numeral 4.

Figure 2:
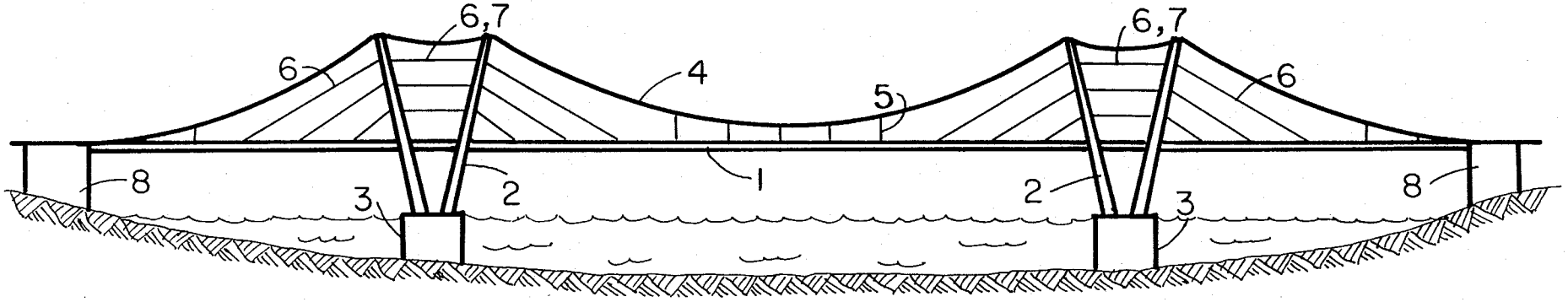
FIG. 2 represents a elevation of the bridge with inclined towers, where the suspension cables are supported by the inclined towers and the inclined cables are either anchored to the bridge superstructure at their ends and supported by the same inclined towers at their median portions or anchored to the bridge superstructure at one of their ends and to the inclined towers at the other ends
Figure 3:
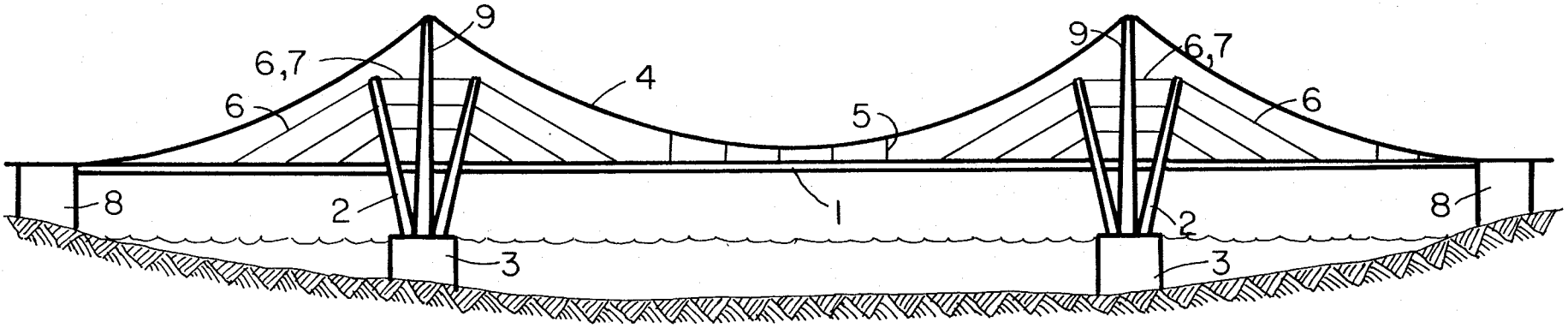
FIG. 3 represents another elevation of the bridge with inclined towers, where the suspension cables are supported by vertical towers and the inclined cables are either anchored to the bridge superstructure at their ends and or supported by the inclined towers, at their median portions or anchored to the bridge superstructure at one of their ends and to the inclined towers at the other ends

Referring to the drawing shown in FIG. 2, the vertical loads from the bridge structure, numeral 1, are transferred to the suspension cables, numeral 4, and the inclined cables, numeral 6. The loads to the suspension cables are transferred through the vertical hangers, numeral 5, in the central zone of the main span and in the zone adjacent to the abutments, numeral 8. The loads from the suspension cables are transferred in part to the inclined towers, numeral 2, and in part to the anchorage system of the abutment, numeral 8. The loads from the inclined cables, numeral 6, are transferred to the inclined towers, numeral 2. To increase the load capacity of the inclined towers, numeral 2, minimizing in the same time the bending moment in the inclined towers, numeral 2, the horizontal cables, numeral 7, are stretched against the inclined towers, numeral 2. The forces from the suspension cables, numeral 4, and inclined cables, numeral 6, combined with the prestressed forces from the horizontal cables, numeral 7, gives a resulting force having the direction of the inclined towers, numeral 2. Referring to the drawing shown in FIG. 3, the vertical loads from the bridge structure, numeral 1, are transferred to the suspension cables, numeral 4, and the inclined cables, numeral 6. The loads to the suspension cables are transferred through the vertical hangers numeral 5, in the central zone of the main span and in the zone adjacent to the abutments, numeral 8. The loads from the suspension cables are transferred in part to the vertical towers, numeral 9, and in part to the anchorage system of the abutment, numeral 8. The loads from the inclined cables, numeral 6, are transferred to the inclined towers, numeral 2. To increase the load capacity of the inclined towers, numeral 2, minimizing in the same time the bending moment in the inclined towers, numeral 2, the horizontal cables, numeral 7, are stretched against the inclined towers, numeral 2. The forces from the inclined cables and suspension cables, numeral 4, numeral 6, combined with the prestressed forces from the horizontal cables, numeral 7, gives a resulting force having the direction of the inclined towers, numeral 2.

Figure 4:
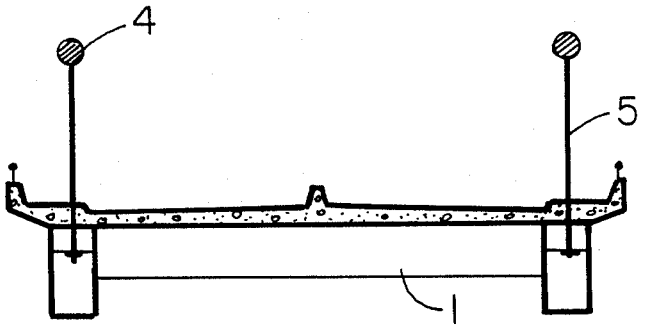
FIG. 4 represents a cross section of the bridge with inclined towers in the portion of the bridge supported by the suspension cables

Referring to the drawing shown if FIG. 4, the vertical hangers, numeral 5, are anchored to the bridge superstructure at one end, numeral 1, and attached to the suspension cable, numeral 4, at the other end.

Figure 5:
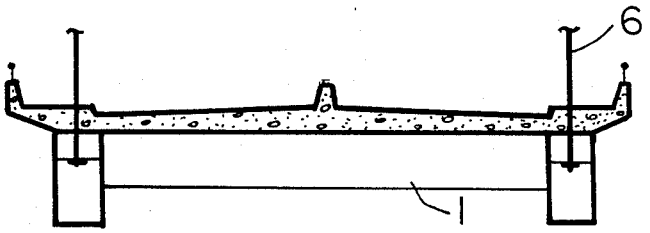
FIG. 5 represents a cross section of the bridge with inclined towers in the portion of the bridge supported by the inclined cables.

Referring to the drawing shown in FIG. 5, the inclined cables are either anchored to or supported by the bridge superstructure, numeral 1, at one end and anchored to the inclined tower at the other end.

I claim:

1. A bridge structure with inclined towers comprising in combination:

two concrete abutments having length, height and width dimensions, one for each end of the bridge, with an anchorage system for each abutment, a bridge superstructure extending longitudinally between said abutments, two piers situated between the two said abutments, each pier comprising a concrete foundation and at least two pair of inclined towers bearing on said concrete foundation and rising substantially above the elevation of said bridge superstructure and extending in the direction of said abutments, at least two suspension cables extending between said abutments, having each end anchored into said anchorages and bearing on the top of said vertical towers, hangers having first ends attached to said suspension cables at one end and second ends attached to said bridge superstructure, inclined cables having first ends anchored along said bridge superstructure at spaced intervals and second ends anchored along the closest said inclined towers at spaced intervals, substantially horizontal cables, extending between and stretched against said pair of inclined towers for introducing a horizontal force of predetermined magnitude; the combination of the horizontal force from said horizontal cables with the forces from said suspension and inclined cables gives a resulting force approximately having the direction of the inclined towers and substantially reducing the bending moment in the inclined towers.

2. A bridge structure with inclined towers as described in claim 1 wherein the said inclined cables have both ends anchored to the said bridge superstructure and bearing symmetrically on the said pair of inclined towers.

3. A bridge structure with inclined towers comprising in combination:

two concrete abutments having length, height and width dimensions, one for each end of the bridge, with an anchorage system for each abutment, a bridge superstructure extending longitudinally between said abutments, two piers situated between the two said abutments, each pier comprising a concrete foundation and at least two vertical towers bearing on said concrete foundation and rising substantially above the elevation of the said bridge superstructure, at least two pairs of inclined towers bearing on said concrete foundation and rising substantially above the elevation of said bridge superstructure and extending in the direction of said abutments, at least two suspension cables extending between said abutments, having each end anchored into said anchorages and bearing on the top of said vertical towers, hangers having first ends attached to said suspension cables at one end and second ends attached to said bridge superstructure, inclined cables having first ends anchored along said bridge superstructure at spaced intervals and second ends anchored along one of said inclined towers at spaced intervals, substantially horizontal cables extending between and stretched against said pair of inclined towers for introducing a horizontal force of predetermined magnitude; the combination of the horizontal force from said horizontal cables with the forces from said suspension and inclined cables gives a resulting force approximately having the direction of the inclined towers and substantially reducing the bending moment in the inclined towers.

4. A bridge structure with inclined towers as described in claim 3 wherein the said inclined cables have both ends to anchored to the said bridge superstructure and bearing symmetrically on the said pair of inclined towers.

* * * * *